US008731447B2

(12) United States Patent
Krucinski

(10) Patent No.: US 8,731,447 B2
(45) Date of Patent: May 20, 2014

(54) SKEW ALIGNING INTERACTING BELTS APPARATUS

(75) Inventor: Martin Krucinski, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 622 days.

(21) Appl. No.: 13/030,805

(22) Filed: Feb. 18, 2011

(65) Prior Publication Data

US 2012/0213558 A1 Aug. 23, 2012

(51) Int. Cl.
*G03G 15/01* (2006.01)

(52) U.S. Cl.
USPC ..... 399/299; 399/300; 399/301; 399/302; 399/312; 399/313; 399/388; 198/806; 198/807; 198/810.03; 474/122

(58) Field of Classification Search
USPC ..... 399/162, 298, 299, 300, 66; 198/806, 198/807, 810.03; 474/122
See application file for complete search history.

(56) References Cited

U.S. PATENT DOCUMENTS 4,370,047 A * 1/1983 Damouth et al. ..... 399/299
5,510,877 A * 4/1996 deJong et al. ..... 399/38
5,930,556 A * 7/1999 Imamiya ..... 399/66
7,046,947 B1 * 5/2006 Castelli et al. ..... 399/307
7,539,453 B2 * 5/2009 Otome et al. ..... 399/384
8,594,543 B2 * 11/2013 Krucinski et al. ..... 399/301
2006/0233569 A1 * 10/2006 Furst et al. ..... 399/162
2009/0317108 A1 * 12/2009 Taki et al. ..... 399/66
2011/0008077 A1 * 1/2011 Moore ..... 399/302
2011/0233857 A1 * 9/2011 Krucinski ..... 271/227
2012/0114351 A1 * 5/2012 Yasumoto ..... 399/66
2012/0213559 A1 * 8/2012 Krucinski ..... 399/302
2013/0108334 A1 * 5/2013 deJong et al. ..... 399/312
2013/0284567 A1 * 10/2013 Beltman et al. ..... 198/807

* cited by examiner

*Primary Examiner* — David Gray
*Assistant Examiner* — Geoffrey Evans
(74) *Attorney, Agent, or Firm* — Hoffman & Baron, LLP

(57) ABSTRACT

Aligning image transfer assembly belts using two driven image-bearing belts simultaneously engaged with a driven transport belt. Each image-bearing belt conveys image-forming marking material formed thereon, wherein the transport belt is selectively engageable by the two image-bearing belts. The selective engagement of each image-bearing belt being independent from the other, wherein the two image-bearing belts are remote from one another. The method and apparatus also output signals representing at least one detected lateral positions of an edge of a measured belt using at least one edge sensor. The detected lateral position measured can be achieved by one or two edge sensors, wherein the two edge sensors would be disposed remote from one another along an extent across which the edge of the measured belt moves. Then a skew indication of the simultaneously engaged two image-bearing belts is determined based on a the output edge sensor(s) signals.

16 Claims, 4 Drawing Sheets

SKEW ALIGNING INTERACTING BELTS APPARATUS

TECHNICAL FIELD

The presently disclosed technologies are directed to controlling and/or improving image registration in a printing system. In particular, it is directed to an apparatus and method for aligning image-bearing belts and a transport belt in an image transfer assembly.

BACKGROUND

In general, many conventional image forming apparatus such as copiers and laser printers employ an electro-photographic system or electrostatic recording system having a configuration in which an electrostatic latent image is formed on an intermediate belt. The latent image consists of charged particles that are formed on an area of the intermediate belt surface for collecting image-forming marking material, generally including one or more predetermined colors. Thus, that intermediate belt is referred to as an image-bearing belt. These initial combined deposits/forms onto the image-bearing belt occur across a region, which will be referred to herein as the "first transfer zone." After the image-forming marking material is formed in the first transfer zone, the image is subsequently transferred on to and fixed on a substrate sheet carried on a transport belt or alternatively transferred to a further intermediate belt. This subsequent transfer occurs in what will be referred to as the "second transfer zone." The second transfer zone generally involves the image-bearing belt interacting with the transport belt, typically and electrostatic transfer belt for conveying sheets of substrate media. For example, in the case of a full-color printing apparatus, there are typically four development units; cyan, magenta, yellow, and black (CMYK) and thus four colors potentially built up on the image-bearing belt in the first transfer zone to create a full-color compilation of the image-forming marking material that gets placed on a substrate sheet in the second transfer zone.

Some imaging systems involve more than one first transfer zone by having two image-bearing belts that each have separate image-forming marking materials formed thereon. The two separate image-forming marking materials are combined onto a common transport belt; in particular onto a common sheet of substrate media, carried by the transport belt, where both images overlap or are otherwise combined. This type of architecture allows for 8-color printing, hexachrome printing (where there are two additional color development units beyond CMYK) or even further toner applications, such as clear toner or a toner with special properties such as MICR (magnetic ink character recognition) toner. In these systems the image-forming marking material is built-up in stages by having the sheet or the further intermediate belt pass through more than one second transfer zone. However, systems that include more than one first transfer zone involve more than one intermediate belt interacting with a common receiving belt, particularly the electrostatic transport belt that conveys the substrate media or alternatively a further intermediate belt.

Transfer of the image(s) to the sheet or further intermediate belt should be in precise registration, otherwise it can cause processing interruptions or delays and/or impair the print quality. If any one of the belts drift or creep laterally, it can change the orientation and position of the sheet carried thereon or the image delivered onto that sheet. Thus, lateral alignment of the belts is critical to ensure proper image-on-print medium registration and proper color-to-color registration.

In systems that include more than one second transfer zone, the interaction between the at least two image-bearing belts and the further common transport belt in the second transfer zones can be the source of registration errors. Misalignment in the process direction of the belts can generate cross-process direction forces that pull laterally on the belts. This pull induces a gradual skew (lateral or angular shifting) of the belt(s) and can negatively effect registration performance in these printing systems. The resulting positioning errors of the belts between the different imaging stations can result in image-on-paper registration errors or color-to-color registration errors, in addition to unnecessary wear from on the misaligned belts.

Accordingly, it would be desirable to provide an apparatus for and method of aligning multi-station image transfer printing systems that have multiple belts interacting with a common belt in order to avoid processing interruptions or delays, poor quality image registration and other shortcomings of the prior art.

SUMMARY

According to aspects described herein, there is disclosed an apparatus for aligning belts in an image transfer assembly. The apparatus includes at least two driven image-bearing belts. Each image-bearing belt conveys image-forming marking material formed thereon. A driven transport belt can be selectively engaged by the at least two image-bearing belts, wherein the selective engagement of each image-bearing belt is independent from at least one other of the at least two image-bearing belts, the at least two image-bearing belts being remote from one another. At least two edge sensors detect a lateral position of an edge of one of the belts. The at least two edge sensors are disposed remote from one another along an extent the edge of the one belt moves across, wherein the at least two edge sensors transmit lateral position signals while two of the at least two image-bearing belts are simultaneously engaged with the transport belt. The lateral position signals provide an indication of a misalignment between the simultaneously engaged image-bearing belts.

According to other aspects described herein, at least one controller can receive the lateral position signals for comparison, wherein the comparison can quantify a measure of the misalignment. The apparatus also can include at least one alignment assembly for automatically adjusting the alignment of the simultaneously engaged image-bearing belts based on the indication of misalignment. The transport belt can be a media transport belt that conveys sheets of substrate media for receiving the image-forming marking materials. The transfer belt can be an intermediate belt directly receiving and bearing the image-forming marking materials thereon. The one belt detected by the edge sensors can be the transport belt. The one belt detected by the edge sensors can be one of the two simultaneously engaged image-bearing belts. Further at least two further edge sensors for detecting a lateral position of an edge of a different one of the belts can be provided.

According to yet further aspects described herein, there is described a method of aligning belts in an image transfer assembly. The method includes simultaneously engaging at least two driven image-bearing belts with a driven transport belt, where each image-bearing belt conveys image-forming marking material formed thereon. The transport belt being one that is selectively engageable by the at least two image-bearing belts, wherein the selective engagement of each image-bearing belt is independent from at least one other of the at least two image-bearing belts. The at least two image-bearing belts can be remote from one another. Also, the method can include outputting signals representing at least two detected lateral positions of an edge of a measured belt using at least two edge sensors. The measured belt being at least one of the image-bearing belts and the transport belt. Each detected lateral position being measured by a different one of the at least two edge sensors, wherein the at least two edge sensors are disposed remote from one another along an extent across which the edge of the measured belt moves. The method further including determining a skew indication of the simultaneously engaged two image-bearing belts based on a comparison of the output signals.

According to other aspects described herein, based on the skew indication an orientation of at least one of the two simultaneously engaged image-bearing belts can be changed for aligning the belts. The measured belt can be the transport belt or at least one of the image-bearing belts. The method can also include outputting supplemental signals that represent at least two supplemental detected lateral positions of a different edge of a further measured belt using at least two supplemental edge sensors. The further measured belt can be a different one of the image-bearing belts and the transport belt. Each supplemental detected lateral position can be measured by a different one of the at least two supplemental edge sensors. The at least two supplemental edge sensors can be disposed remote from one another along an extent across which the edge of the further measured belt moves. The transport belt can be a media transport belt conveying sheets of substrate media directly thereon. The transport belt can be an intermediate belt conveying image-forming marking material transferred from the image-bearing belts directly thereon. A controller can receive the output signals, wherein the controller makes the skew indication determination and automatically initiates changes to an orientation of at least one of the two simultaneously engaged image-bearing belts for aligning at least two of the transport belt and the image-bearing belts. At least one alignment assembly can receive control signals from the controller and adjusts the alignment of the simultaneously engaged image-bearing belts based on the skew indication.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
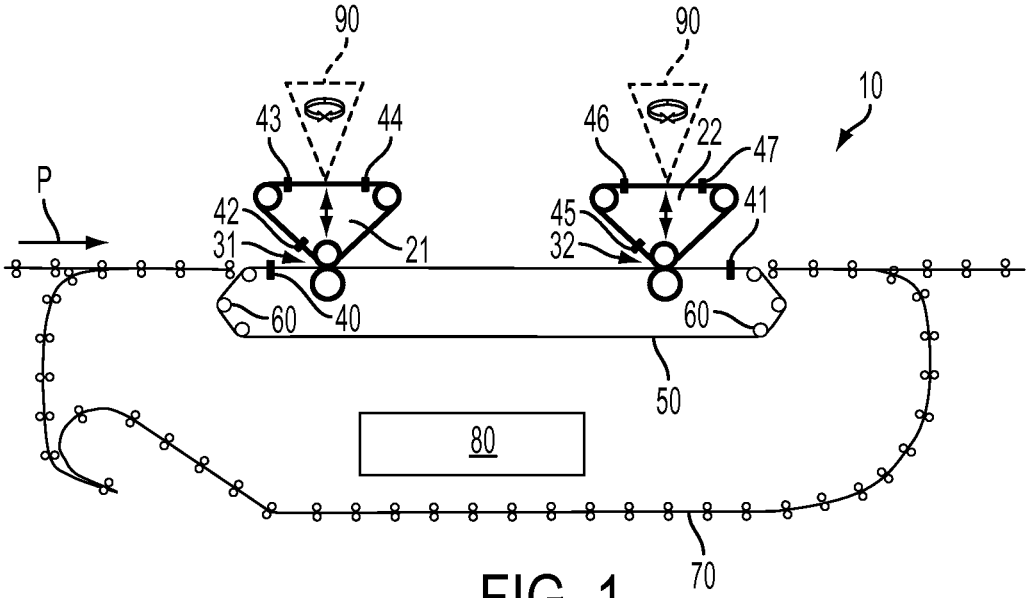
FIG. 1 is a schematic elevation view of an image transfer assembly in accordance with aspects of the disclosed technologies.

Describing now in further detail these exemplary embodiments with reference to the Figures. An apparatus and method is disclosed for more accurately aligning interacting belts for improved image registration on a substrate media or an intermediate transport belt in a printing system. Thus, a portion of an exemplary image transfer assembly is illustrated herein, as well as an application of same to a modular assembly for printing.

As used herein, a "printer" or "printing system" refers to one or more devices used to generate "printouts" or a print outputting function, which refers to the reproduction of information on "substrate media" for any purpose. A "printer" or "printing system" as used herein encompasses any apparatus or portion thereof, such as a digital and/or analog copier, bookmaking machine, facsimile machine, multi-function machine, etc. which performs a print outputting function.

A printing system can use an "electrostatographic process" to generate printouts, which refers to forming and using electrostatic charged patterns to record and reproduce information, a "xerographic process", which refers to the use of a resinous powder, such as toner, on an electrically charged plate, roller or belt and reproduce information, or other suitable processes for generating printouts, such as an ink jet process, a liquid ink process, a solid ink process, and the like. Also, such a printing system can print and/or handle either monochrome or color image data.

As used herein, "substrate media" refers to, for example, paper, transparencies, parchment, film, fabric, plastic, or other substrates on which information can be reproduced, preferably in the form of a sheet or web.

As used herein, the term "belt," "transfer belt," "transport belt," "image-bearing belt" and "intermediate belt" refers to, for example, an elongated flexible web supported for movement along a process flow direction. For example, an image-bearing belt is capable of conveying an image in the form of toner or other marking material for transfer to a substrate media. Such formed toner or other marking material, prior to being deposited on a substrate media is referred to herein as a "image-forming marking material." Another example includes a media transport belt, which preferably engages and/or carries a substrate media that receives marking material within a printing system. Such belts can be endless belts, looping around on themselves within the printing system in order to continuously operate. Accordingly, endless belts move in a process direction around a loop in which they circulate. A belt can engage a substrate media and/or carry marking material in the form of an image thereon over at least a portion of the loop. Image-bearing belts carry marking material in the form of a image-forming marking material. Image-bearing belts can include non-stretchable electrostatic or photoreceptor belts capable of accumulating toner thereon.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as referred to herein can include one or more point sensors and/or array sensors for detecting and/or measuring characteristics of a belt, image or substrate media, such as speed, orientation, process or cross-process position, size or even thickness. Thus, reference herein to a "sensor" can include more than one sensor. An "edge sensor" is a type of sensor particularly suited for detecting a lateral position of an edge of a belt or sheet of substrate media.

As used herein, the term "process direction" refers to a direction along a path associated with a process of printing or reproducing information on substrate media. The process direction is a flow path in which a belt moves as part of the system in order to convey an image and/or a substrate media from one location to another within the printing system. A "cross-process direction" is generally perpendicular to the process direction. Also, use of the terms "upstream" or "downstream" use the process direction as a reference, with the downstream direction being synonymous with the process direction and the upstream direction being opposite thereto. Further, use of the terms "lateral" or "lateral direction" are synonymous with the cross-process direction.

As used herein, the terms "nip" or "transfer nip" refer to the interface between two rollers, one roller and a belt or two belts, where image-forming marking material is transferred from one surface (e.g., drum, roller or belt) to another surface (i.e., drum, roller, belt or substrate). Also, as used herein the "nip assembly" generally includes the drum(s), roller(s), belt (s) and supporting or related structure associated with a particular nip.

As used herein, the term "image-forming marking material" refers to toner, wax or other particles intended to mark a substrate with a complete image or a portion of an image. Image-forming marking material can be collected or compiled on a transfer surface, such as a drum, roller or belt. For example, an area of charged particles, known as a latent image, can be formed on a photoreceptor that is then intended to receive toner. Once the toner is compiled on the charged area on the photoreceptor, it is an example of image-forming marking material.

The presently disclosed technologies utilize module-to-modules skew alignment procedures in order to control and/or improve image registration in a printing system. The methods herein can be implemented at the time of assembly, calibration or during operation, in order to align modules along the process direction. The methods relate to an imaging system that involves more than one second transfer zone by having two image-bearing belts, each separately conveying image-forming marking materials, for transfer to and being combined onto a common transfer belt. Such a transfer belt can carrying a sheet or be a further intermediate belt. As referred to herein, each subassembly delivering an image to a "second transfer zone," as described above, is considered part of a "module"; whether the subassembly is a separate detachable unit or integrally formed with other modules within one system. Any skew misalignment in the process direction between the modules will lead to pulling forces either in the in-board or out-board direction of each belt as the transfer nips are each closed and pressurized in the second transfer zone. In accordance with an aspect of the disclosed technologies herein, by detecting the belt walk of any one of the interacting belts and adjusting the orientation of one or more modules, skew between the modules can be minimized along with the lateral pulling forces associated with it. In this way, an amount of belt walk can be measured using existing belt edge sensors or with additional belt sensors close to one or more belt transfer zones. Upon taking such measurements, the angular alignment between modules can be adjusted by an operator or automatically by electro-mechanical means. Such automatic adjustments could be performed during special alignment modes, preferably without paper. The system and methods described herein are applicable to all systems with interacting belts and should not be limited to the printing systems used in the exemplary embodiments herein.

FIG. 1 is a schematic side elevation view of a portion of an image transfer assembly 10 that includes a media transport belt 50. The image transfer assembly 10 can be part of a printer, where the transport belt 50 conveys sheets for receiving marking material, such as ink. In one aspect of the disclosed technologies, the image transfer assembly is of an electrostatographic or xerographic type, and includes image receptors in the form of multiple photoreceptor belts, more generally referred to herein as "image-bearing belts." The image-bearing belts each carry marking material, such as toner, developer particles, etc., of a given type to a nip assembly that has a transfer nip 31, 32 in order to transfer the marking material to a sheet of substrate media conveyed by a media transport belt 50. The transfer nips 31, 32 coincide with the second transfer zones described above. The media transport belt 50 conveys the sheets along a primary media path P, but can re-circulate the sheets through other paths, including an inverter path 70 that carries the sheet back across the media transport belt 50. As with contemporary systems, the media transport belt 50 can be supported by rollers 60. The position, at least laterally, of the belt 50 is measured/detected by sensors 40, 41 that transmit signals to a controller 80, which can be used for alignment as further described below.

The image bearing belts 21, 22 each represent separate image transfer subsystems or modules for transferring image-forming marking material in their respective transfer nips 31, 32. The nips 31, 32 of the second transfer zones can be selectively opened or closed, as with typical nip assemblies. In this way, when either nip 31, 32 is closed, the corresponding image bearing belt 21, 22 engages the transport belt 50 and potentially a passing sheet of substrate media. Also, when the nip 31, 32 is opened, the image bearing belt 21, 22 disengages the transport belt 50. The opening and closing of the nips 31, 32 is generally initiated by the controller 80 or some other control system.

Each transfer nip 31, 32 corresponds to a respective transfer module with image bearing belts 21, 22. The nips 31, 32 bring each image bearing belt 21, 22 into engagement with or at least in close proximity to the transfer belt 50. Thus, each transfer nip 31, 32 corresponds to a secondary transfer zone, which is defined by a region where marking material is directly transferred from one surface to another. For example, from the image bearing belt to the substrate sheet or from the image bearing belt to another intermediate transfer belt. The nip assemblies generally include a driven roller and an opposed idler roller. Thus, the media transport belt 50 carries a substrate media in the form of a series of sheets through each transfer nip 31, 32 for each sheet to receive the respective marking material from each of the image bearing belts 21, 22. Alternatively, the nip assemblies can be other than an opposed single pair of rollers, as long as it forms a transfer area for the sheets to receive marking material. The transfer belts 50 or other sheet handling systems 70 can also make the sheets available for further printing or processing by subsequent systems (not shown). The transport belts 50 can include a single endless belt, as shown, looping back around through a portion of the sheet path P that passes through the transfer zones.

During normal operations, these nips 31, 32 are both closed. When a nip is said to be "closed," the conveying and receiving surfaces are made to engage. For example, nip 31 is closed when image bearing belt 21 engages transport belt 50. The nip can be "opened", meaning the conveying and receiving surfaces are not engaged or are disengaged from one another. Typically in high color printing, where up to 8 colors are used, both nips need to be closed as image transfers to the substrates are taking place in each nip concurrently. As sheets are being transported continuously through the system with small inter-sheet spacing, there is little to no opportunity to serially open and close nips, such as nips 31, 32. Thus, both nips remain closed from the beginning of the print job and open after the last sheet of that job has been printed. Thus, when closed the nips 31, 32 engage the transfer belt 50, ready to transfer image-forming marking material from one belt 21, 22 to another 50. During calibration or other operations, the nips 31, 32 can be either open or closed as needed.

In accordance with an aspect of the disclosed technology herein, the image bearing belts 21, 22 preferably included at least one edge sensor, such as one of sensors 42-47. These sensors can each detect the position of one of the an endless loop belts 21, 22. Using a single edge sensor for each belt 21, 22 allows a determination to be made of a general belt position for the measured belt. Using two edge sensors for one belt refines that determination, providing belt position and skew. Using edge sensors on more than one side or section of the image bearing belts 21, 22 can help determine skewing across a greater span of the belt and particularly on different sides of the support rollers or nips. In accordance with an aspect of the disclosed technologies, as many as four photoreceptor drums, each forming transfer nips, can be disposed along the top of the spans for each endless loop belt 21, 22. Thus, it is helpful to be able to adjust the location and skew of the images written by, for example, lasers on several drums to match the geometry of image transport from one nip to another nip along a span, such as the top span, of each of the endless loop belts 21, 22. Additional sensors could be used with their associated increase in information/accuracy balanced by their associated increase in production/maintenance costs.

More generally, the larger group of sensors 40-47 detect the position and certain characteristics of the media transfer belt 50, typically in the form of edge sensors. Such sensors 40-47 can also be used to detect a sheet movement and/or position. Tracking or detecting belt movement is useful since individual sheets remain fairly well secured to the transfer belt 50 and thus the sheet movement generally corresponds well to the position of the transfer belt 50. Thus, the position and/or other characteristics of a sheet can be detected indirectly by sensing at least a portion of the transport belt 50. Also, as a further alternative, a combination of individual sheet and/or belt sensors can be employed as part of a sensor group. Further, it should be understood that sensors 40-47 need not be identical, so that the configuration and/or composition of individual sensors included could be varied. The sensors 40-47 can have the capability, in terms of response time and image resolution, to detect positional and other anomalies of transport belt movement, and output a "signal" related to measurements, particularly anomalies. This signal in turn can be used to steer the belt to a more desirable position. The sensor(s) 40-47 can be used to detect the position or speed of transport belt 50, by way of edge sensing or measuring some other portion of the transport belt 50.

The sensors 40, 41 include sensors disposed on opposed sides, in the process direction, of the marking engine and particularly the transfer area(s), with at least one sensor 40 on the upstream side of a transfer area and another sensor 41 on the downstream side. It should be understood that although the transfer belt 50 is only shown with edge sensors 40, 41, additional edge sensors can be used. In particular, edge sensors can be placed both upstream and downstream of each secondary transfer zone. These further sensors could be used to determine an average displacement across the actual transfer zones.

In accordance with an aspect of the disclosed technologies, the signal(s) output by one or more sensors can be collected, compiled and/or processed by what is here called a "controller." Contemporary media handling assemblies use controllers, in the form of automated processing devices, in order to maintain control of the sheets, the images and the systems handling each. The controller 80, represents the one or more controllers used in accordance with aspects of the disclosed technologies herein. The controller 80 takes the signals received from the sensors 40-47, in order to determine a skew indication or misalignment between the various intermediate image bearing belts 21, 22 and the media transfer belt 50. Thus, the controller 80 can be used to receive the data output by the sensors for aligning the overall assembly and improving image registration.

The sensors 40-47 can include edge sensors, point sensors or virtually any sensing technique, in order to detect and/or measure transport belt position. It should be understood that a fewer or greater number of sensors could be used, limited only by the amount of information desired to be obtained by such sensors. Also, in a modular system signals from sensors 40-47 across the modules can be used collectively. Further, the sensors 40-47 can be positioned closer to or further from the transfer area than that shown in the illustrations. Positioning sensors 40-47 as close as possible to the transfer area can reflect more accurately movements occurring within or across the transfer area, but often this is limited by space and/or other components that normally reside in the same vicinity. Additionally, sensors 40, 41 can be positioned adjacent to and in close proximity to the transfer nips 31, 32.

In accordance with an alternative embodiment, the image transfer assembly associated with each image bearing belt 21, 22 can be discreet subassemblies with automated actuation devices that together act as an alignment assembly 90 for pivoting the respective modules in order to correct their alignment along the process direction P. In this way, the modules could be pivoted around an axis perpendicular to the sheet path P (i.e., an axis extending vertically in the orientation shown in FIG. 1).

Figure 2:
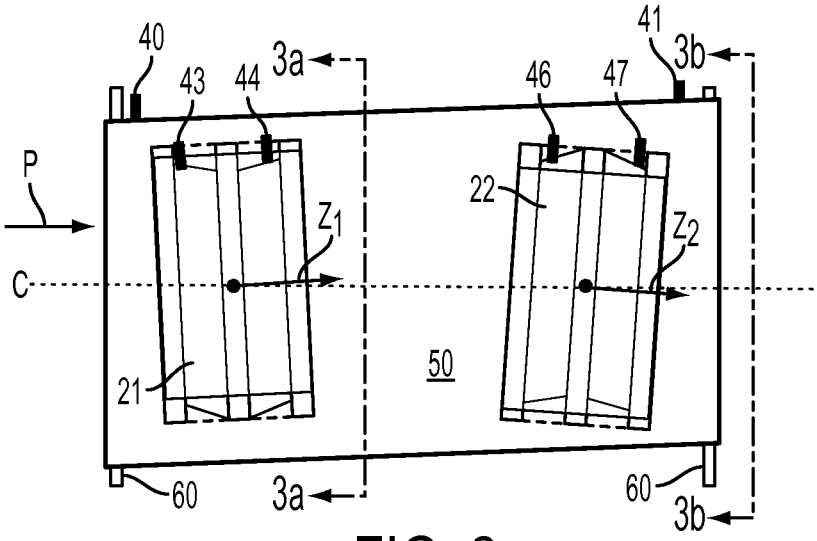
FIG. 2 is a schematic plan view of the image transfer assembly of FIG. 1, without the sheet inverter and the outer sheet path assemblies, in accordance with aspects of the disclosed technologies.

FIG. 2 is a plan view of the media transport belt 50 of FIG. 1, isolated with portions of the rollers 60 and sensors 40, 41, in addition to the two modules with their image bearing belts 21, 22 and the upper most sensors 43, 44, 46, 47. In the orientation shown in FIG. 1, the media transport belt 50 would normally operate by circulating in a clockwise direction. Thus, in the orientation shown in FIG. 2, a sheet delivered to the media transport belt 50 in the process direction P would get conveyed from left to right, through the two image transfer modules that include the image bearing belts 21, 22. It should be understood that the skew misalignment, as well as the lateral displacement of the belts shown in the illustrations herein is exaggerated for more easily visualizing disturbances addressed by the apparatus and method disclosed herein. As illustrated, the first image bearing belt 21 has a net velocity vector $Z_1$ which is directed slightly away from the center line C of the transfer belt 50. Similarly, the second image bearing belt 22 is illustrated having a misalignment with the velocity vectors $Z_2$ also slightly away from the centerline C, but in the opposite lateral direction. It should be understood that these misalignments can occur for various reasons, including manufacturing tolerances and differences in thermal expansions of the various parts in the printing system. Also, interactions with other systems such as the hot fuser module located immediately adjacent to these transfer stations can misalign the modules relative to each other and the process path P. These and other factors lead to misalignment of the velocity vectors $Z_1$, $Z_2$ across the multiple secondary transfer zones 31, 32. When each of the transfer zone nips are closed and pressurized, this misalignment induces cross-process direction forces, particularly in the transfer zones 31, 32. Such cross-process direction forces in the transfer zones lead to belt skew and/or shifting, particularly where two belts make contact in close proximity to one another.

Figure 3A:
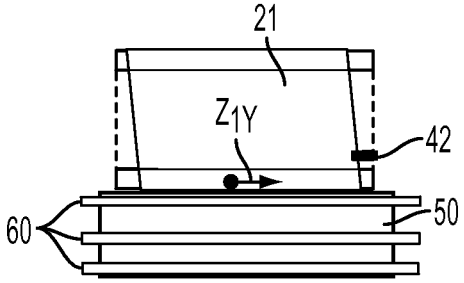
FIG. 3*a* is a sectional front elevation view taken at 3*a*-3*a*, as indicated in FIG. 2.
Figure 3B:
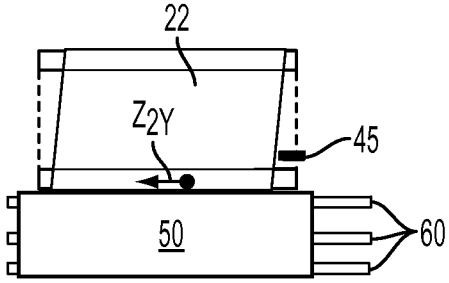
FIG. 3*b* is a front elevation view taken at 3*b*-3*b*, as indicated in FIG. 2.

FIGS. 3*a* and 3*b* show front views of the individual image bearing belts 21, 22 (looking upstream, which is opposite to the process path P) interacting with the transfer belt 50, respectively, as taken from FIG. 2 where noted. In particular, FIG. 3*a* and FIG. 3*b* illustrate a condition where each of the separate modules with the separate image bearing belts 21, 22 have simultaneously been made to engage the transfer belt 50. The dual engagement of both image bearing belts 21, 22 with the transfer belt 50 induces the cross-process force vectors $Z_{1Y}$, $Z_{2Y}$ respectively. Such cross-process force vectors represent only the lateral component of the each module's velocity vectors $Z_1$, $Z_2$ in the secondary transfer zone. In this way, the portions of the image bearing belts 21, 22 that engage the transfer belt 50 shift and/or are skewed in a direction of those respective forces. Thus, referring back to FIG. 2, it should be noted that the upstream side (left side as shown in drawings) of transfer belt 50 is shifted slightly below the center line C whereas the downstream side (right side in drawing) is shifted slightly above the center line C. Similarly, referring back to FIGS. 3*a* and 3*b*, the image bearing belts 21, 22 also see a shift in the direction of those loading forces $Z_{1Y}$, $Z_{2Y}$. The supplemental edge sensors 42, 45 measuring a lower extent of the image bearing belt paths, can help detect further misalignments between different regions of the belts.

Figure 4:
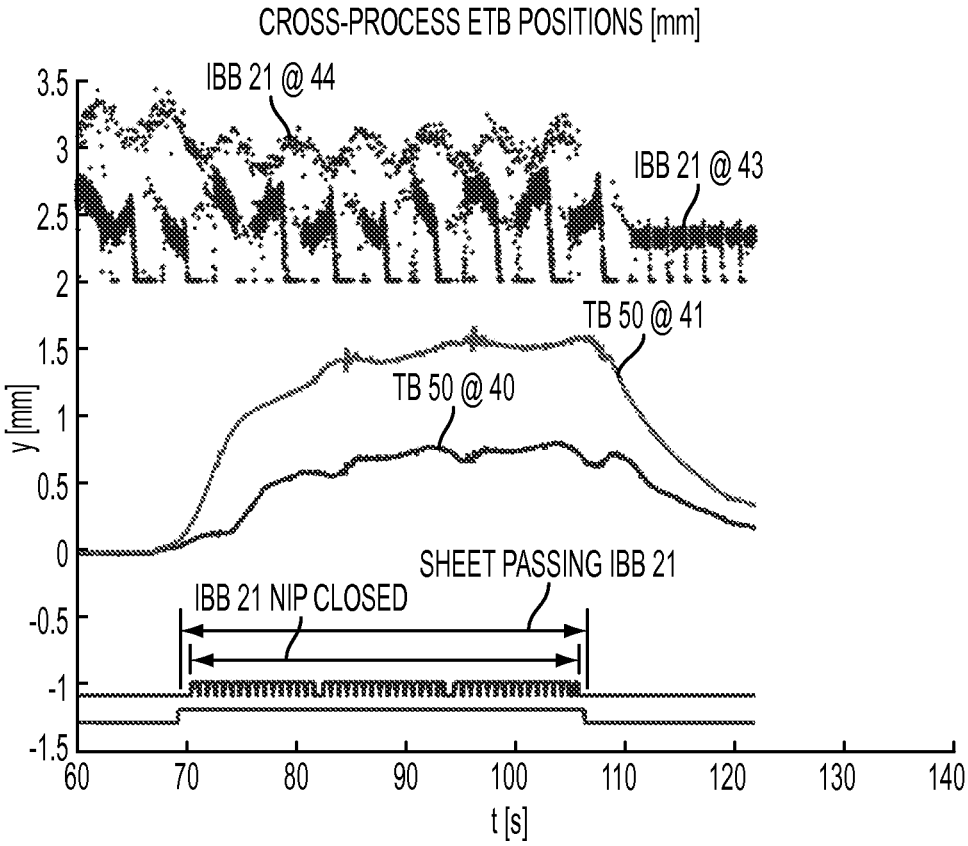
FIG. 4 is a graphical representation of various measured lateral belt displacements, in accordance with aspects of the disclosed technologies.

FIG. 4 illustrates plotted results of experimentation in an imaging system having two second transfer zones, in particular, two image bearing belts engaged with a common media transfer belt. The configuration would be similar to the embodiment shown in FIG. 1. During those tests, 45 sheets of paper were run through the printing system and displacement was measured of a transfer belt similar to transfer belt 50, using sensors similarly disposed as sensors 40 and 41. Also, an intermediate transfer belt similar to the upstream image bearing belt 21 was measured with sensors disposed similarly to that of sensors 43 and 44. The 45 sheets were run through the print job at 80 pages per minute, passing through the first second transfer zone from approximately T=70 seconds to T=105 seconds as indicated as "sheet passing IBB 21". During the period in which the sheets are passing, both the transfer belt 50 and image bearing belt 21 move considerably from a color-to-color registration perspective. As shown from the graph, the displacement of the image bearing belt 21 results in a much more scattered (noisy) plot, but a clear pattern of movement is discernible. The upstream side of image bearing belt 21 as measured at sensor 43 clearly displaces less than the downstream side of image bearing belt 21 as measured at sensor 44. Similarly, when examining the displacement of the transfer belt 50 as measured at sensors 40 and 41, the downstream displacement is significantly higher.

Figure 5:
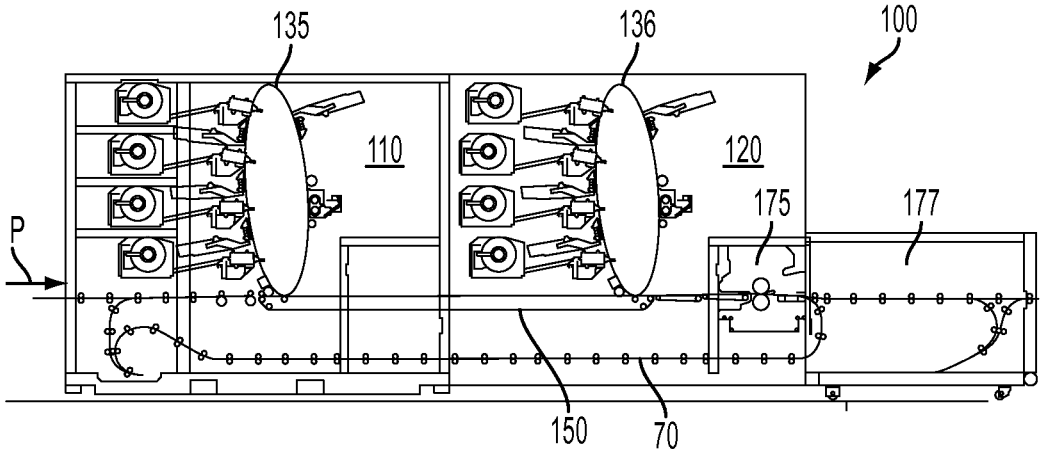
FIG. 5 is a schematic elevation view of a modular assembly of printing systems in accordance with aspects of the disclosed technologies.

FIG. 5 is a schematic side elevation view of a portion of an alternative image transfer assembly 100 that also uses a media transport belt 150. The image transfer assembly 100 includes two modular subassemblies 110, 120 configured similarly to that of image transfer assembly 10, but with more explicit modular design. Each module 110, 120 includes an intermediate transfer assembly 135, 136 with a plurality of imaging stations positioned in series adjacent to the outer surface of an intermediate transfer belt of the intermediate transfer assembly 135, 136. The intermediate transfer belt circulates through multiple imaging stations (C, M, Y, K) in order to assembly or compile a more complete image enabling full-color imaging thereon. The full-color image can then be transferred at each transfer nip from the intermediate transfer belt to a print medium (e.g., a sheet of paper) carried by a mutual media transport belt 150. As with other sheet path belts 70, the media transport belt extends through both modular subassemblies 110, 120. In this embodiment, the media transport belt 150 is shown to be supported by fewer rollers and circulates in a somewhat different path. However, it should be understood that rollers can be configured to support the media transport belt 150 in almost any way and still remain within the scope of the present disclosure, as long as the belt 150 can be steered accordingly. Similarly, the assembly 100 includes a fuser 175 and collection bin 177, but could have other elements or even further modular assemblies added thereto.

In all the embodiments disclosed herein and in accordance with the broadest aspects of the disclosed technologies herein, either a single controller 80 or more than one discrete controllers can be provided. For example, individual controllers can be provided for any submodules or subset of sensors as desired.

It should be understood that alternatively, the transport belt, as shown in FIG. 5, could include a belt that extends along and between more than one printing system 110, 120 such as a plurality of modular printing systems. FIG. 5 is a side elevation view of a modular printing assembly 100, including more than one image transfer assembly 110, 120 arranged in series. In possible implementations, a central processor (not shown) is provided, for governing and coordinating a plurality of printing subsystems, including individual modules 110, 120 of a modular system. The central processor can interact and coordinate individual controllers within each module 110, 120, where each module 110, 120 by itself could be considered printing system.

Correction of positional anomalies within or between a series of modules 110, 120 along a print path P can be divided between the controllers associated with each module or a central controller (not shown) controlling the steering across the print path of those modules. In one implementation, anomalies within a predetermined spatial range can be corrected internally within less than all the modules to be handled by an internal controller therein. For example, a single module in response to a detected anomaly can perform a correction, entirely apart from the other modules. Larger or cumulative spatial anomalies can be handled by the central controller. Another arrangement could provide for the central controller to detect recurrent patterns of positional errors and command individual modules accordingly.

Figure 6:
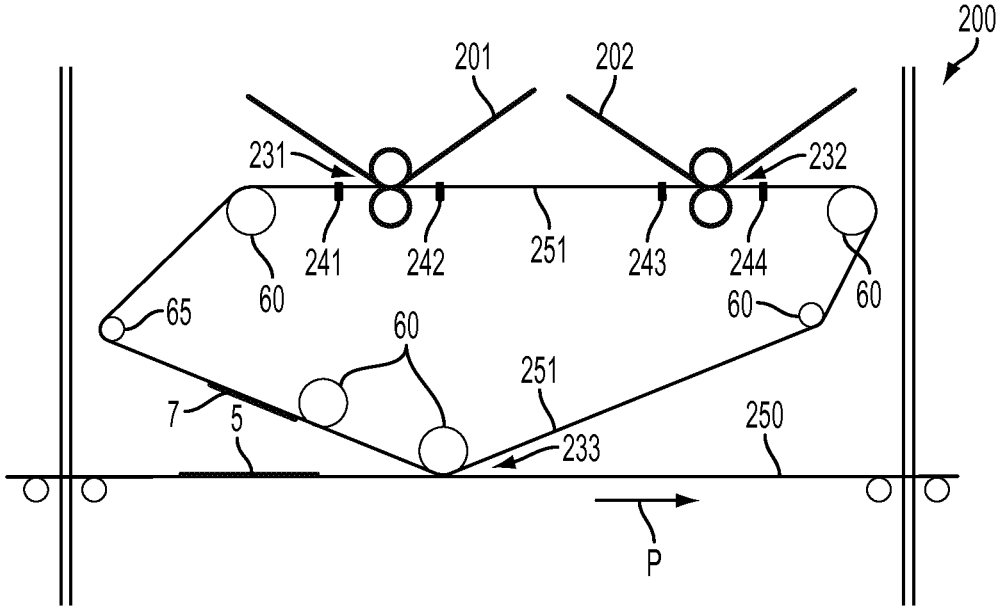
FIG. 6 is a schematic elevation view of another image transfer assembly in accordance with aspects of the disclosed technologies.

While the illustrated embodiments are directed to a substrate media transfer belt, it should be understood that the disclosed technologies can be applied to an intermediate transfer belt or virtually any media transfer belt. FIG. 6 shows a simplified view of an exemplary image transfer assembly 200 that uses an intermediate transfer belt 251. The intermediate transfer belt 251 is supported by guide rollers 60, 65 and includes nips 231, 232 with its rollers. Additionally the image transfer assembly 200 includes more than one image bearing belt 201, 202 that carries an image to an image transfer area corresponding to each of the nips 231, 232. Further, the intermediate transfer belt 251 is guided to a further transfer nip 233, where image-forming marking material 7 carried by the image bearing belt 251 gets transferred to a sheet 5 carried by a further transport belt 250 in a process direction P. It should be noted that while all the sensors and rollers illustrated can be identical to the others of their kind in all respects other than their location within the system, they can also be different if it is desirable.

The illustrated embodiments relate to so-called "digital" printing systems, in that the marking engine, whether electrostatographic, ink jet, or some other printing technology, ultimately relying on input image data in digital form. Alternatively, other types of printing system could be used, particularly in a modular assembly. Even modules using non-digital technology could be designed to be responsive to transfer belt correction based on anomalies detected by a sensing system.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims, as originally presented and as they may be amended, encompass variations, alternatives, modifications, improvements, equivalents, and substantial equivalents of the embodiments and teachings disclosed herein, including other marking technologies such ink jet printing and those that are presently unforeseen or unappreciated, and that, for example, may arise from applicants/patentees and others.

Figure 7:
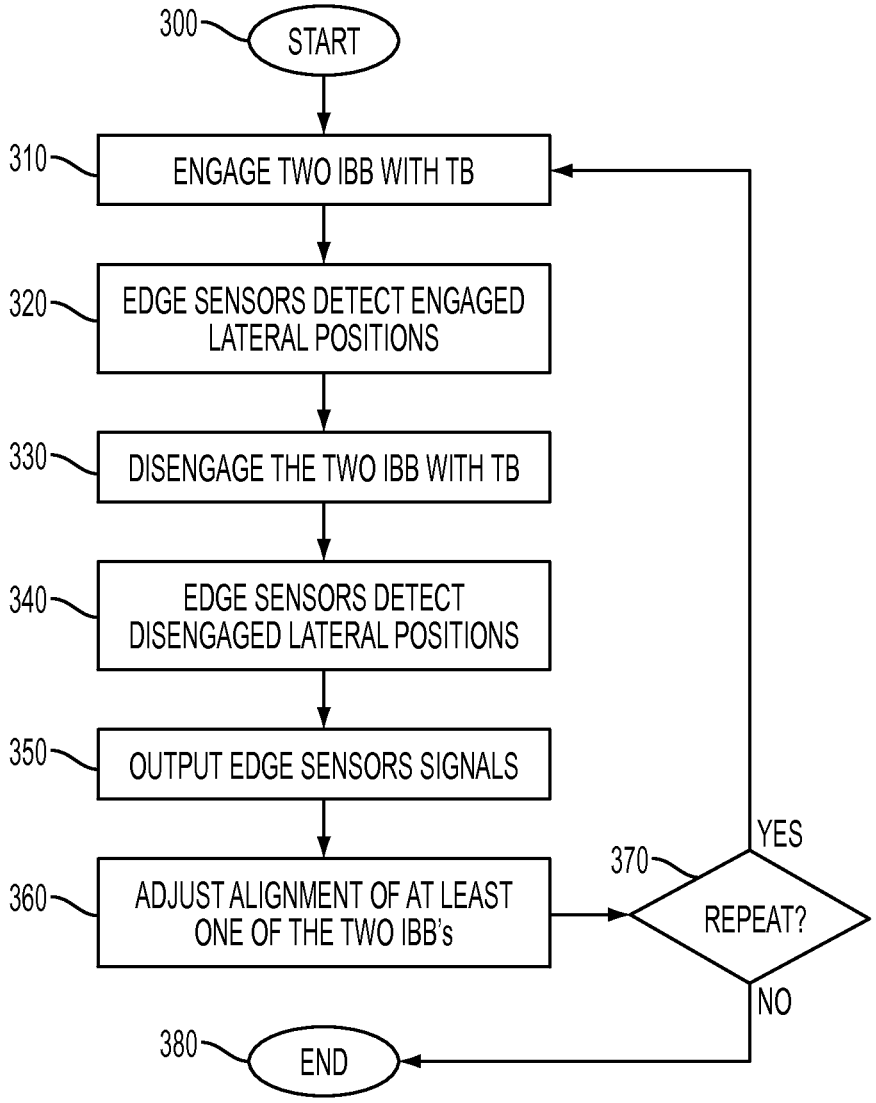
FIG. 7 is a process flow diagram in accordance with aspects of the disclosed technologies.

Thus, the methods herein can be implemented as shown in the process flow diagram of FIG. 7. When starting the alignment procedure of step 300, all the normally operating belts in the printing system can be started in order to get an operating environment as similar as possible to that which would be occurring in a typical operation mode. It should be understood that the methods herein could be applicable to printing systems that have more than two secondary transfer zones (belt-to-belt interaction zones. Accordingly, the belts in any further modules corresponding to those additional secondary transfer zones should be started as well. In step 310, two adjacent nip assemblies from those interaction zones should be closed such that two image bearing belts (IBB's) each engage a common transfer belt (TB). Thereafter, in step 320, the edge sensors will detect lateral displacement of the engaged image bearing belts and/or the transfer belt. These measurements can be taken continuously throughout the period or sporadically at points during this period of dual engagement. Thereafter, in step 330, the nips should be opened such that the two image bearing belts that were closed in step 310 are now disengaged from the transfer belts. Thereafter in step 340, the edge sensors can continue to detect the lateral positions of the respective belts in the system. Then, in step 350, the output edge sensor signals can be used to measure lateral cross-process position changes. These position changes can be used to realign the belt transport modules in step 360 relative to each other along the process direction. Thus, lining-up the velocity vectors generated by each module at its point of interaction with the transfer belt. In this way, the induced belt motion during belt interaction will be minimized in future iterations. This procedure should be repeated for all sets of adjacent secondary transfer zones or, if it is desirable, the detecting/measuring/monitoring of the system can be repeated/continued. Thus, in step 370, if the method described above is to be repeated, it will proceed back to step 310. Otherwise, it can proceed to step 380 where this alignment protocol would be terminated. In this way, the belts and their associated belt edge sensors are used for determining the amount of cross-process pulling/pushing occurring during the belt-to-belt interactions. A significant degree of these pulling/pushing forces can be attributed to misalignments of the sub-modules and particularly, the belts themselves. By adjusting and aligning the force vectors generated at the secondary transfer areas, belt walk and/or skew can be minimized. It should be understood that any alignment of the modules as described herein can be done manually by an operator, automatically by electro-mechanical means continuously during printing or during special alignment runs (with or without paper), or a combination thereof.

The alignment and calibration procedure described herein is preferably done without sheets of paper run through the system. However, running sheets through the system during calibration can be done, as the module to module misalignment forces will still be present when sheets are passing through the nips.

Additionally, while more than two secondary transfer zone nips can be closed simultaneously during the above calibration procedure, it is preferable to identify the source of belt displacement by having only one secondary transfer zone nip closed at a time. However, in some printing system architectures only one or fewer than all image bearing belts 21, 22 will have an alignment assembly 90 for pivotally adjusting that image bearing belt. Such an architecture can take advantage of the fact that an adjustment of the transfer belt 50 will affect the interface at both nips 21, 22 and thus have both nips closed to do so. The calibration procedure above can be also performed sequentially across the secondary transfer zone nips, one nip at a time, in virtually any order desired.

What is claimed is:

1. An apparatus for aligning belts in an image transfer assembly, the apparatus comprising:

first and second driven image-bearing belts, each image-bearing belt for conveying image-forming marking material formed thereon;

a driven transport belt selectively engaged independently by the first and second image-bearing belts, wherein the selective engagement of each image-bearing belt is independent from the selective engagement of the other of the image-bearing belts, the first and second image-bearing belts being remote from one another; and a first edge sensor for detecting a lateral position of the first driven image-bearing belt relative to a centerline, the first edge sensor adjacent to an edge of the first driven image-bearing belt the first edge sensor transmitting lateral position signals corresponding to a skew of a net velocity vector of the first driven image-bearing belt relative to the centerline; and a second edge sensor for detecting a lateral position of the second driven image-bearing belt relative to the centerline, the second edge sensor adjacent to the edge of the second driven image-bearing belt, the second edge sensor transmitting lateral position signals corresponding to a skew of a net velocity vector of the second image-bearing belt relative to the centerline, while the first and second image-bearing belts are simultaneously engaged with the transport belt, wherein the lateral position signals provide an indication of a misalignment between the simultaneously engaged image-bearing belts.

2. The apparatus of claim 1, further comprising:

at least one controller receiving the lateral position signals for comparison, wherein the comparison quantifies a measure of the misalignment.

3. The apparatus of claim 1, further comprising:

at least one alignment assembly for automatically adjusting the alignment of the simultaneously engaged image-bearing belts based on the indication of misalignment.

4. The apparatus of claim 1, wherein the transport belt is a media transport belt that conveys sheets of substrate media for receiving the image-forming marking material.

5. The apparatus of claim 1, wherein the transport belt is an intermediate belt directly receiving and bearing the image-forming marking material thereon.

6. The apparatus of claim 1, further comprising:

a third edge sensor for detecting a lateral position of an edge of the transport belt relative to the centerline.

7. The apparatus of claim 1, wherein the first edge sensor includes at least two edge sensors for detecting a lateral position of the first driven image-bearing belt relative to the centerline, the at least two edge sensors disposed remote from one another.

8. The apparatus of claim 1, wherein the first edge sensor includes at least three edge sensors for detecting a lateral position relative to the centerline of the first driven image-bearing belt, the at least three edge sensors disposed remote from one another.

9. A method of aligning belts in an image transfer assembly, the method comprising:

simultaneously engaging first and second driven image-bearing belts with a driven transport belt, each image-bearing belt conveying image-forming marking material formed thereon, wherein the transport belt is selectively engageable independently by the image-bearing belts, the selective engagement of each image-bearing belt being independent from the selective engagement of the image-bearing belts, wherein the first and second image-bearing belts are remote from one another;

outputting signals representing a lateral position relative to a centerline of the first driven image-bearing belt using a first edge sensor, the first edge sensor transmitting lateral position signals corresponding to a skew of a net velocity vector of the first driven image bearing belt relative to the centerline;

outputting signals representing a lateral position relative to the centerline of the second driven image-bearing belt using a second edge sensor, the second edge sensor transmitting lateral position signals corresponding to a skew of a net velocity vector of the second driven image bearing belt relative to the centerline; and determining a skew indication of the simultaneously engaged two image-bearing belts based on the output signals.

10. A method of aligning belts of claim 9, wherein based on the skew indication an orientation of at least one of the two simultaneously engaged image-bearing belts is changed for aligning the belts.

11. A method of aligning belts of claim 9, further comprising:

outputting supplemental signals representing at least two supplemental detected lateral positions of an edge of the transport belt using a third edge sensor, each supplemental detected lateral position measured by the third edge sensor.

12. A method of aligning belts of claim 9, wherein the transport belt is a media transport belt conveying sheets of substrate media directly thereon.

13. A method of aligning belts of claim 9, wherein the transport belt is an intermediate belt conveying image-forming marking material transferred from the image-bearing belts directly thereon.

14. A method of aligning belts of claim 9, wherein a controller receives the output signals, the controller makes the skew indication determination and automatically initiates changes to an orientation of at least one of the two simultaneously engaged image-bearing belts for aligning the first and second driven transport belts and the image-bearing belts.

15. A method of aligning belts of claim 14, wherein at least one alignment assembly receives control signals from the controller and adjusts the alignment of at least one of the two simultaneously engaged image-bearing belts based on the skew indication.

16. A method of aligning belts of claim 9, wherein the first edge sensor includes at least two edge sensors for detecting a lateral position relative to a centerline of the first driven image-bearing belt.

* * * * *